United States Patent [19]

Gibson et al.

[11] 4,006,854

[45] Feb. 8, 1977

[54] WIRE DISPENSER CONTAINER

[75] Inventors: Obediah Daniel Gibson, Duxbury, Mass.; Daniel Philip Kazes, Putnam, Conn.

[73] Assignee: International Paper Company, New York, N.Y.

[22] Filed: Nov. 26, 1975

[21] Appl. No.: 635,290

[52] U.S. Cl. ..... 229/17 S; 206/409; 229/52 B; 242/171

[51] Int. Cl.[2] ..... B65D 5/72; B65D 5/46

[58] Field of Search ..... 229/36, 52 B, 51 D, 229/17 S; 242/171; 206/409, 395

[56] References Cited

UNITED STATES PATENTS

| | | | |
|---|---|---|---|
| 1,431,352 | 10/1922 | Abbott | 206/409 |
| 1,481,592 | 1/1924 | Dozier | 229/52 B |
| 1,640,368 | 8/1927 | Obetz et al. | 206/409 |
| 2,579,131 | 12/1951 | Tinsley | 206/409 |
| 2,663,485 | 12/1953 | Johnson | 229/52 B X |
| 2,974,850 | 3/1961 | Mayer | 206/409 X |
| 3,112,058 | 11/1963 | Martin | 229/36 |
| 3,161,289 | 12/1964 | Leysen | 206/395 |
| 3,543,995 | 12/1970 | Wilson | 229/36 |
| 3,680,810 | 8/1972 | Jarmalow | 242/171 |
| 3,684,158 | 8/1972 | Harris | 229/17 RS |

*Primary Examiner*—Davis T. Moorhead
*Attorney, Agent, or Firm*—Ronald A. Schapira

[57] ABSTRACT

A cut and scored, paperboard blank and the hexahedronal container formed from the blank. The container has bottom, top and end walls reinforced by at least one additional layer of paperboard material. The container features a handle construction which is connected to one of the side walls and is located within the container and beneath its top wall until the handle is positioned outwardly of the container, by the two steps of: partially opening the container by folding the side panels away from each other; and then, closing the container by folding the side panels towards each other, while urging the handle through a slot in the top wall of the container. The container also features a key shaped hole in an end wall of the container through which a roll of wire, in the container, can be dispensed and which is adapted to hold the end of the wire outwardly of the container in a readily accessible position. The container further features a plurality of interfolded bottom, top and end wall panels adapted to strengthen the container and improve the impact resistance of its bottom, top and end walls.

39 Claims, 13 Drawing Figures

WIRE DISPENSER CONTAINER

BACKGROUND OF THE INVENTION

This invention relates to a reinforced container for carrying and dispensing wire, such as insulated electrical wire. This invention particularly relates to a container having improved strength and impact resistance. This invention also particularly relates to a container having a strong integral handle that can be quickly and easily folded into an upright position, extending outwardly of the container, when the container is to be carried about or used for dispensing wire. This invention further particularly relates to a hole arrangement in the layers of material which form an end wall of the container whereby wire can be easily dispensed from the container and the end of the wire can be kept in a readily accessible position outwardly of the container.

Paperboard containers for dispensing wire are well known in the prior art. Such containers often have been provided with one or more reinforced walls. See, for example, U.S. Pat. No. 3,161,289. Typically, such containers also have been provided with holes through which wire can be dispensed without opening the containers. See, for example, U.S. Pat. Nos. 1,431,352, 2,974,850, and 3,680,810. Frequently, containers suitable for carrying wire and the like further have been provided with integral handles. See, for example, U.S. Pat. Nos. 2,663,485, and 1,481,592.

However, such containers have not been entirely satisfactory for use as wire dispenser containers, particularly where the wire has been a relatively heavy, insulated electrical wire. Generally, such containers have not been reinforced about their bottom, top and end walls. As a result, these containers often have not had sufficient impact resistance, when filled, to withstand the effects of being dropped from heights, e.g., 20 feet or more, and to not open or break apart. Also, the containers typically have not been provided with handle constructions which can be easily and quickly set-up by consumers when ready to carry the containers or dispense wire therefrom. Furthermore, such containers have not, in general, included means for securing the ends of wires in a position that is readily accessible to a user's grasp at times when wire is not being dispensed from the containers. Frequently, the containers still further have not been sufficiently strong to be filled with 20 to 50 pounds of wire and the like and the be held by their handles, when carrying or dispensing wire, without tearing. In addition, the heretofore available wire dispenser containers have been deficient in not providing all of the aforementioned features in a single container construction.

SUMMARY OF THE INVENTION

In accordance with this invention, a cut and scored, paperboard blank for a hexahedronal container, having bottom, top and end walls reinforced by at least one additional layer of paperboard material, is provided, which comprises:

a bottom panel;

a first side panel and aa second side panel connected to opposite sides of the bottom panel;

a first end panel and a second end panel connected to opposite sides of the first side panel;

a first, first end panel reinforcing flap connected to a side of the first end panel remote from the first side panel;

a first, second end panel reinforcing flap connected to a side of the second end panel remote from the first side panel;

a second, first end panel reinforcing flap and a second, second end panel reinforcing flap connected to the other opposite sides of the bottom panel;

a top panel connected to a side of the first side panel remote from the bottom panel;

a third, first end panel reinforcing flap and a third, second end panel reinforcing flap connected to opposite sides of the top panel;

a first top panel reinforcing flap connected to a side of the top panel remote from the first side panel;

a first bottom panel reinforcing flap connected to a side of the first, first end panel reinforcing flap remote from the third, first end panel reinforcing flap;

a second bottom panel reinforcing flap connected to a side of the first, second end panel reinforcing flap remote from the third, second end panel reinforcing flap;

a fourth, first end panel reinforcing flap and a fourth, second end panel reinforcing flap connected to opposite sides of the second side panel;

a second top panel reinforcing flap connected to a side of the second side panel remote from the bottom panel;

a third top panel reinforcing flap connected to a side of the second top panel reinforcing flap remote from the second side panel;

a fourth top panel reinforcing flap connected to a side of the fourth, first end panel reinforcing flap remote from the first end panel; and a fifth top panel reinforcing flap connected to a side of the fourth, second end panel reinforcing flap remote from the second end panel;

the first end panel, the first end panel reinforcing flaps, and the fourth top panel reinforcing flap being adjacent to one another; and the second end panel, the second end panel reinforcing flaps, and the fifth top panel reinforcing flap being adjacent to one another.

This blank provides a hexahedronal container construction having interfolded and reinforced, bottom, top, and end walls, which comprises:

a bottom wall formed by the bottom panel and the adjacent, overlying, first and second, bottom panel reinforcing flaps;

a pair of side walls formed by the upstanding first and second side panels;

one end wall formed by the upstanding first end panel and the adjacent, upstanding first, first end panel reinforcing flap, upstanding second, first end panel reinforcing flap, downwardly extending third, first end panel reinforcing flap, and upstanding fourth, first end panel reinforcing flap;

the other end wall formed by the upstanding second end panel, and the adjacent, upstanding first, second end panel reinforcing flap, upstanding second, second end panel reinforcing flap, downwardly extending third, second end panel reinforcing flap, and upstanding fourth, second end panel reinforcing flap; and a top wall formed by the top panel and the adjacent, underlying, first, second, third, fourth and fifth, top panel reinforcing flaps; the fourth and fifth, top panel reinforcing flaps being positioned between the second and third, top panel reinforcing flaps, and the first top panel reinforcing flap being positioned between the top panel and the second top panel reinforcing flap.

Also in accordance with this invention, the blank and the hexahedronal container can have an integral handle construction, which comprises:

an elongated slot in the top panel; and a pair of handle slits in the second top panel reinforcing flap located between the lengthwise ends of the slot in the top panel and extending from the side of the second top panel reinforcing flap remote from the second side panel.

Further in accordance with this invention, the blank and the hexahedronal container can include a hole through which wire can be dispensed from the container, which comprises:

a key shaped hole in the first end panel, the key shaped hole comprising a substantially round wire-dispensing hole connected to an elongated wire-retaining slot, having a width substantially less than the diameter of the round wire-dispensing hole; and a substantially round wire-dispensing hole in one of the first end panel reinforcing flaps.

The hexahedronal container of this inventin is well adapted for carrying and dispensing wire. It features: superior impact resistance, even when filled and dropped from a height of 20 feet; an integral handle which can be quickly and easily assembled in two simple steps; sufficient strength to hold 20 to 50 pounds, without tearing when held by its handle; and a key shaped hole for easy dispensing of wire, as well as access to the end of the wire.

DETAILED DESCRIPTION OF THE INVENTION

Figure 1:
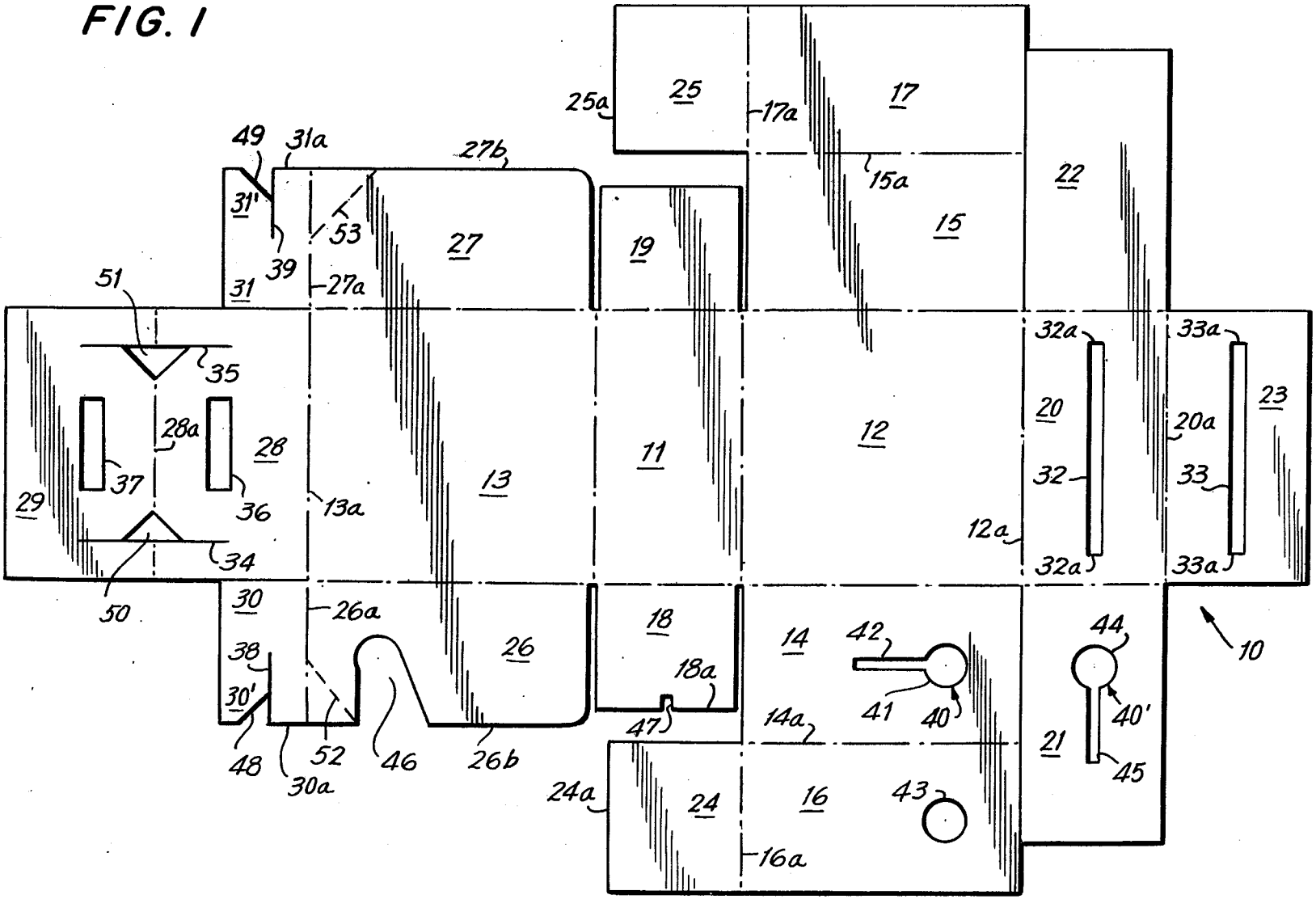
FIG. 1 is a plane view of a paperboard blank, in accordance with this invention, for forming a hexahedronal wire-dispensing container.

Shown in FIG. 1 is a one-piece paperboard blank, generally 10, in accordance with this invention. The blank 10 is adapted to be folded into a one-piece hexahedronal container, generally 60, shown in FIGS. 6 to 13.

As seen from FIG. 1, the blank 10 includes a substantially rectangular, bottom panel 11. Foldably connected to opposite sides of the bottom panel 11 are a generally rectangular, first side panel 12 and a generally rectangular, second side panel 13. Foldably connected to opposite sides of the first side panel 12 are a generally rectangular, first end panel 14 and a generally rectangular, second end panel 15. Foldably connected to the side 14a of the first end panel 14 remote from the first side panel 12 is a generally rectangular, first, first end panel reinforcing flap 16. Foldably connected to the side 15a of the second end panel 15 remote from the first side panel 12 is a generally rectangular, first, second end panel reinforcing flap 17.

Foldably connected to the other opposite sides of the bottom panel 11 are a generally rectangular, second, first end panel reinforcing flap 18 and a generally rectangular, second, second end panel reinforcing flap 19. The second, first end panel reinforcing flap 18 is located adjacent to the first end panel 14, and the second, second end panel reinforcing flap 19 is located adjacent to the second end panel 15 in blank 10.

Foldably connected to the side 12*a* of the first side panel 12 remote from the bottom panel 11 is a generally rectangular, top panel 20. Foldably connected to opposite sides of the top panel 20 are a generally rectangular, third, first end panel reinforcing flap 21 and a generally rectangular, third, second end panel reinforcing flap 22. The third, first end panel reinforcing flap 21 is located adjacent to the first end panel 14, and the third, second end panel reinforcing flap 22 is located adjacent to the second end panel 15. Foldably connected to the side (20*a*) of the top panel 20 remote from the first side panel 12 is a generally rectangular, first top panel reinforcing flap 23.

Foldably connected to the side 16a of the first, first end panel reinforcing flap 16 remote from the third, first end panel reinforcing flap 21 is a generally rectangular, first bottom panel reinforcing flap 24. Foldably connected to the side 17a of the first, second end panel reinforcing flap 17 remote from the third, second end panel reinforcing flap 22 is a generally rectangular, second bottom panel reinforcing flap 25. Foldably connected to opposite sides of the second side panel 13 are generally rectangular, fourth, first end panel reinforcing flap 26 and a generally rectangular, fourth, second end panel reinforcing flap 27. The fourth, first end panel reinforcing flap 26 is located adjacent to the second, first end panel reinforcing flap 18, and the fourth, second end panel reinforcing flap 27 is located adjacent to the second, second end panel reinforcing flap 19.

Foldably connected to the side 13a of the second side panel 13 remote from the bottom panel 11 is a generally rectangular, second top panel reinforcing flap 28. Foldably connected to the side 28a of the second top panel reinforcing flap 28 remote from the second side panel 13 is a generally rectangular, third top panel reinforcing flap 29. Foldably connected to a side 26a of the fourth, first end panel reinforcing flap 26 remote from the first end panel 14 is a generally rectangular, fourth top panel reinforcing flap 30. Foldably connected to a side 27*a* of the fourth, second end panel reinforcing flap 27 remote from the second end panel 15 is a generally rectangular, fifth top panel reinforcing flap 31. The fourth and fifth top panel reinforcing flaps 30 and 31 are located adjacent to the second top panel reinforcing flap 28.

Provided in the top panel 20 is an elongated, generally rectangular, first slot 32, and provided in the first top panel reinforcing flap 23 is an elongated, generally rectangular, second slot 33. The location and dimensions of the elongated first and second slots 32 and 33 are not critical, so long as the slots 32 and 33, i.e., their lengthwise center lines, are substantially parallel to and equidistant from the connected sides of the top panel 20 and the first top panel reinforcing flap 23. Preferably, the slots 32 and 33 are centered between the opposite sides of the top panel 20 and the first top panel reinforcing flap 23 respectively. It also is preferred that the slots 32 and 33 have approximately equal lengths, as measured along the side 20a of top panel 20, and approximately equal widths, and that the widths of the slots 32 and 33 be at least equal to twice the thickness of the paperboard material used in blank 10.

Provided in both the second and third top panel reinforcing flaps 28 and 29 are a first handle slit 34 and a second handle slit 35, extending completely through the thickness of these flaps 28 and 29. The first and second handle slits 34 and 35 are parallel to each other. The slits 34 and 35 also are transverse to the connected sides of the second and third top panel reinforcing flaps 28 and 29. The first handle slit 34 is located closer to fourth top panel reinforcing flap 30, and the second handle slit 35 is closer to the fifth top panel reinforcing flap 31.

Provided between the first and second handle slits 34 and 35 in the second top panel reinforcing flap 28 is an elongated, generally rectangular, third slot 36. Provided between the first and second handle slits 34 and 35 in the third top panel reinforcing flap 29 is an elongated, generally rectangular, fourth slot 37. The third and fourth slots 36 and 37, i.e., their lengthwise center lines, are substantially parallel to and equidistant from the abutting sides of the second top panel reinforcing flap 28 and the third top panel reinforcing flap 29. The side of the third slot 36 remote from the third top panel reinforcing flap 29 lies along a line connecting the ends of handle slits 34 and 35 in the second top panel reinforcing flap 28. Similarly, the side of the fourth slot 37 remote from the second top panel reinforcing flap 28 lies along a line connecting the ends of handle slits 34 and 35 in the third top panel reinforcing flap 29.

The location of the first and second handle slits 34 and 35 in the second and third top panel reinforcing flaps 28 and 29 is not critical, so long as, if extended, they are located: between the opposite lengthwise ends 32*a* and 33*a* of the first and second slots 32 and 33; and substantially transverse to the slots 32 and 33, i.e., their lengthwise center lines. Preferably, the handle slits 34 and 35 are equally spaced from the center of side 28*a* of the second top panel reinforcing flap 28. Also, the dimensions of the handle slits 34 and 35 are not critical so long as the handle slits are of substantially equal length in the second top panel reinforcing flap 28 and in the third top panel reinforcing flap 29. Preferably, the first and second handle slits 34 and 35 are of equal length and are sufficiently long so that the third and fourth slots 36 and 37 lie partially or entirely, preferably entirely, between the ends of the first and second handle slits 34 and 35. In this regard, it is especially preferred that one side of each slot 36 and 37, remote from side 28a of the second top panel reinforcing flap 28, lie along one of the lines that are transverse of the handle slits 34 and 35 and that connect the ends of the handle slits in the second and third top panel reinforcing flaps 28 and 29. It is also preferred that the width of the first and second handle slits 34 and 35 be that of a conventional knife cut. However, the slits 34 and 35 also can, if desired, be substantially wider.

The dimensions and location of the third and fourth slots 36 and 37 also are critical. Preferably, the slots 36 and 37 are sufficiently large so that a hand can be easily passed through them when grasping a handle member, generally 70, that is formed in the container 60 from the portions of the second and third top panel reinforcing flaps 28 and 29 between the first and second handle slits 34 and 35. It is also preferred that the third and fourth slots 36 and 37 be centered between the first and second handle slits 34 and 35 in the second and third top panel reinforcing flaps 28 and 29.

Provided in the fourth top panel reinforcing flap 30 is a third handle slit 38. The third handle slit 38 is parallel to the side 26a of the fourth, first end panel reinforcing flap 26 that is connected to the fourth top reinforcing flap 30. The third handle slit 38 is spaced from the parallel side 26a of the fourth, first end panel reinforcing flap 26 by a distance equal to the distance between the first handle slit 34 and the side of the second top panel reinforcing flap 28 between the second and fourth top panel reinforcing flaps 28 and 30. Similarly, the fifth top panel reinforcing flap 31 includes a fourth handle slit 29. The fourth handle slit 39 is parallel to the side 27*a* of the fourth, second end panel reinforcing flap 27 connected to the fifth top panel reinforcing flap 31 and is spaced from the parallel side 27*a* of the fourth, second end panel reinforcing flap 27 by a distance equal to the distance between the second handle slit 35 and the side of the second top panel reinforcing flap 28 between the second and fifth top panel reinforcing flaps 28 and 31. The third and fourth handle slits 38 and 39 each have a length equal to or greater than, preferably equal to, one-half of the length of either the first or second handle slits 34 or 35. The slits 38 and 39 preferably are knife cuts but can, if desired, be substantially wider.

Provided in the first end panel 14 is a key shaped hole, generally 40. The first key shaped hole 40 comprises a first, substantially round, wire-dispensing hole 41 connected to a first elongated wire-retaining slot 42. The first wire-retaining slot 42 has a width that is substantially less than the diameter of the first wire-dispensing hole 41 and not substantially greater than the diameter of the wire being dispensed. However, the location, dimensions and configuration of the first key shaped hole 40 and its first wire-dispensing hole 41 and first wire-retaining slot 42 in the first end panel 14 are not critical. Preferably, the first wire-dispensing hole 41 is much wider, e.g., 1 to 2 inches wider, than the diameter of the wire to be dispensed from the container. The first wire-retaining slot 42, by comparison, preferably has a width equal to or slightly less than the diameter of the wire being dispensed and a length of approximately 2 to 6 inches. It is also preferred that the first wire-dispensing hole 41 be circular and that the first wire-retaining slot 42 be substantially rectangular. However, other configurations can be suitably utilized, e.g., elliptical first wire-dispensing holes 41 and parabolic first wire-retaining slots 42.

In the blank 10 of this application, the first wire-dispensing hole 41 and the first wire-retaining slot 42 can be separated by a distance of, for example, 1 to 2 inches. The first key shaped hole 40, however, represents a preferred arrangement of this invention in providing both: means 41 in the first end panel 14 through which wire can be dispensed; and means 42 for holding the end of a roll of wire in a readily accessible position outwardly of the container 60 yet substantially flush with the outside of the end wall of the container.

Provided in the first, first end panel reinforcing flap 16 is a second, substantially round, wire-dispensing hole 43. The second wire-dispensing hole 43 is located in flap 16 in a position whereby the first wire-dispensing hole 41 and the second wire-dispensing hole 43 are substantially aligned in the container 60 formed from blank 10. However, as in the first wire-dispensing hole 41, the dimensions, location and configuration of the second wire-dispensing hole 43 are otherwise not critical. Preferably, the second wire-dispensing hole 43 has essentially the same dimensions and configuration as those of the first wire-dispensing hole 41.

Provided in the third, first end panel reinforcing flap 21 is a second key shaped hole, generally 40'. The second key shaped hole 40' comprises a third, substantially round, wire-dispensing hole 44 and a second elongated wire-retaining slot 45, having a width substantially less than the third wire-retaining hole 44. As in the first key shaped hole 40, the location, configuration and dimensions of the second key shaped hole 40' and its wire-dispensing hole 44 and its wire-retaining slot 45 are not critical, so long as the third wire-dispensing hole 44 is aligned with the first and second wire-dispensing holes 41 and 43 in the container 60 formed from the blank 10 and so long as the second wire-retaining slot 45 is substantially aligned with the first wire-retaining slot 42 in the container 60 formed from the blank 10. The dimensions and configuration of the second key shaped hole 40' preferably are comparable to the dimensions and configuration of the first key shaped hole 40.

Provided in the fourth, first end panel reinforcing flap 26 and extending from the side thereof remote from the second side panel 13 is a wire-dispensing first elongated notch 46. The dimensions and configuration of the first notch 46 are not critical. However, the first notch 46 must be located in the fourth, first end panel reinforcing flap 26 so that a substantial portion thereof is aligned with the wire-dispensing holes 41, 43 and 44 in the container 60 formed from blank 10. The first notch 46 also should be at least as wide as the diameter of the smallest of the wire-dispensing holes 41, 43 and 44.

Provided in the second, first end panel reinforcing flap 18 and extending from the side thereof remote from the bottom panel 11 is a wire-retaining second elongated notch 47. The dimensions and configuration of the second notch 47 are not critical and preferably are comparable to those of the first wire-retaining slot 42 in the first key shaped holee 40. The location of the second notch 47 also is not critical so long as, in the container 60 formed from the blank 10, notch 47 is aligned with a significant portion of the wire-retaining slots 42 and 45 in the key shaped holes 40 and 40'.

The use of the second wire-retaining slot 45 and the second notch 47 in blank 10 is considered preferred but not critical. If desired, particularly where the paperboard material is relatively thick or the wire to be dispensed is relatively thin, the second wire-retaining slot 45 can be eliminated without substantially interfering with the ability of the first wire-retaining slot 42 and the second notch 47 to hold the end of the wire in a readily accessible position outwardly of the container 60 formed from the blank 10. Similarly, the second notch 47 in the second, first end panel reinforcing flap 18 can, if desired, be eliminated where a very thick papaerboard material is utilized in blank 10, relative to the wire being dispensed, or where the side 18a of the second, first end panel reinforcing flap 18 remote from the bottom panel 11 does not come between the wire-retaining slots 42 and 45 of the first end panel 14 and the third, first end panel reinforcing flap 21 in the container 60 formed from blank 10.

Provided in the fourth top panel reinforcing flap 30 is a first handle notch 48. The first handle notch 48 extends from the side **30*a* of the fourth top panel reinforcing flap 30 remote from the second top panel reinforcing flap 28. One side of the first handle notch 48 is coextensive with the third handle slit 38 in the fourth top panel reinforcing flap 30 and preferably extends for a distance of about 1 to 3 inches along the third handle slit 38. The other side of the first handle notch 48 is located in a portion 30' of the fourth top panel reinforcing flap 30 that is remote from the fourth, first end panel reinforcing flap 26 and bounded by the third handle slit 38**.

A second handle notch 49 is provided in the fifth top panel reinforcing flap 31. The second handle notch 49 extends from the side 31a of the fifth top panel reinforcing flap 31 remote from the second top panel reinforcing flap 28. One side of the second handle notch 44 extends along the fourth handle slit 39, preferably for a distance of about 1 to 3 inches. The other side of the second handle notch 49 lies in a portion 31' of the fifth top panel reinforcing flap 31 that is remote from the fourth, second end panel reinforcing flap 27 and bounded by the fourth handle slit 39.

Provided in the second and third top panel reinforcing flaps 28 and 29 are a first handle cut-out 50 and a second handle cut-out 51. One side of the first handle cut-out 50 extends along the first handle slit 34, and one side of the second handle cut-out 51 extends along the second handle slit 35. Preferably, the handle cut-outs 50 and 51 are centered about the abutting sides of the second and third top panel reinforcing flaps 28 and 29.

The dimensions and configurations of the handle notches 48 and 49 and the handle cut-outs 50 and 51 are not critical. However, it is preferred that the handle cut-outs 50 and 51 be symmetrical about the abutting sides of the second and third top panel reinforcing flaps 28 and 29 and that the first and second handle notches 48 and 49 respectively have the same dimensions and configurations as the symmetrical halves of the handle cut-outs 50 and 51. It is particularly preferred that the handle notches 48 and 49 comprise triangles and that the handle cut-outs 50 and 51 comprise triangles having at least two equal sides.

Provided in the fourth, first end panel reinforcing flap 26, between its side 26a connected to the fourth top panel reinforcing flap 30 and its side **26*b* remote from the second side panel 13, is a first scored crease line 52. Provided in the fourth, second end panel reinforcing flap 27, between its side 27*a* connected to the fifth top panel reinforcing flap 31 and its side 27*b* remote from the second side panel 13, is a second scored crease line 53. The particular location and length of each crease line 52 and 53 are not critical. Preferably, the first and second crease lines 52 and 53; include an angle of approximately 30° with the sides 26*a* and 27*a* respectively. The crease lines 52 and 53 can be scored in any conventional manner which will permit the fourth, first and second end panel reinforcing flaps 26 and 27 to be slightly creased or bent during the assembly of container 60**.

The paperboard material utilized in the blank 10 is not critical, and any relatively rigid paperboard material conventionally utilized in paperboard containers for dispensing rope, twine or wire, particularly insulated electrical wire and the like, can be utilized. Preferably, single wall corrugated board is utilized as the paperboard material in blank 10.

The panels and flaps 11–31 of blank 10 have been described as being foldably connected. These panels and flaps can be foldably connected in any conventional manner which will allow them to be suitably interfolded to form a strong and impact resistant container 60 for relatively heavy amounts of wire and the like. Preferably, panels and flaps 11–31 are foldably connected along scored fold lines.

In blank 10, the dimensions of the panels and flaps 11–31 are not critical. However, each side of a flap or panel of blank 10 which is foldably connected to a side of another flap or panel preferably has a length equal to the length of the side of the flap or panel to which it is foldably connected. Also, the lengths and widths of the panels preferably are selected so that: the dimensions of the top and bottom panels 11 and 20 are substantially the same; the dimensions of the side panels 12 and 13 are substantially the same; the dimensions of the end panels 14 and 15 are substantially the same; and the length, the width, or both the length and width of the reinforcing flaps 16–19 and 21–31 are substantially the same as their respective corresponding panels 11–15 and 20. Thereby, the flaps and panels can be closely interfolded to form a strong and impact resistant, rigid container.

Figure 2:
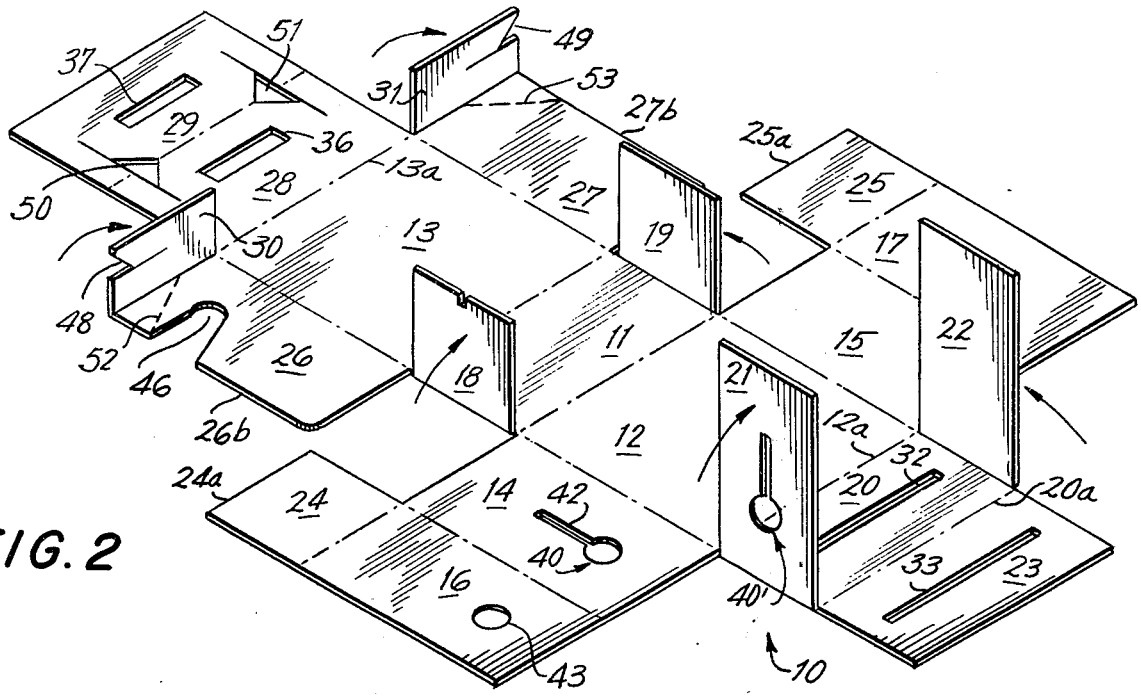
FIG. 2 is a perspective view of a partially assembled container, formed from the blank shown in FIG. 1.

Shown in FIG. 2 is the first step in folding the blank 10 into the hexahedronal, wire dispenser container 60 of this application. As seen in FIG. 2, the second, first end panel reinforcing flap 18, the second, second end panel reinforcing flap 19, the third, first end panel reinforcing flap 21, the third, second end panel reinforcing flap 22, the fourth top panel reinforcing flap 30 and the fifth top panel reinforcing 31 have been folded into an upstanding position relative to the remainder of blank 10.

Figure 3:
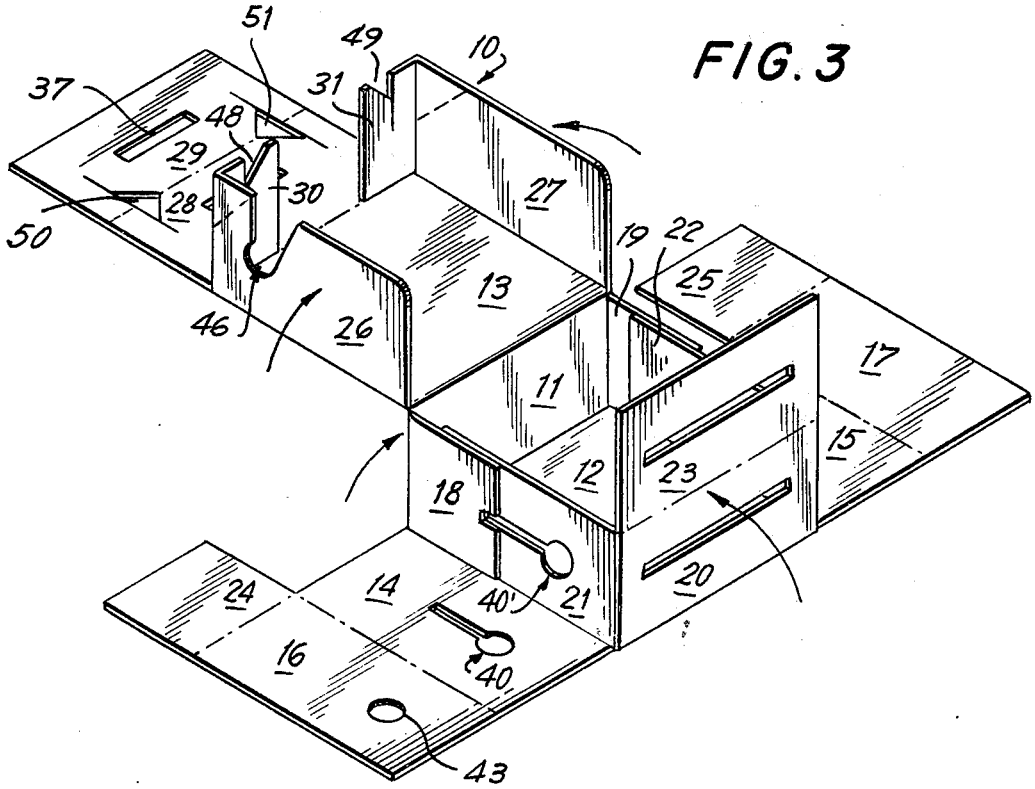
FIG. 3 is a perspective view of a partially assembled container, formed from the partially assembled container shown in FIG. 2.

Shown in FIG. 3 is the second step in folding the blank 10 to form the container 60. In FIG. 3, the bottom panel 11 has been folded into an upstanding position relative to the first side panel 12. As folded, the bottom panel 11 also extends downwardly relative to the second side panel 13. Also in FIG. 3, the top panel 20 has been folded into an upstanding position relative to the first side panel 12. Further in FIG. 3, the fourth, first end panel reinforcing flap 26 and the fourth, second end panel reinforcing flap 27 have been folded into an upstanding position relative to the second side panel 13. As a result, the third, first end panel reinforcing flap 21, the third, second end panel reinforcing flap 22, the second, first end panel reinforcing flap 18 and the second, second end panel reinforcing flap 19 are in an upstanding position relative to the first side panel 12; and the fourth and fifth top panel reinforcing flaps 30 and 31 are in an upstanding position relative to the second side panel 13. Also as a result, the second, first end panel reinforcing flap 18 is located outwardly of and in face-to-face relationship with a bottom portion of the third, first end panel reinforcing flap 21; and the second, second end panel reinforcing flap 19 is located outwardly of and in face-to-face relationship with a bottom portion of the third, second end panel reinforcing flap 22.

Figure 4:
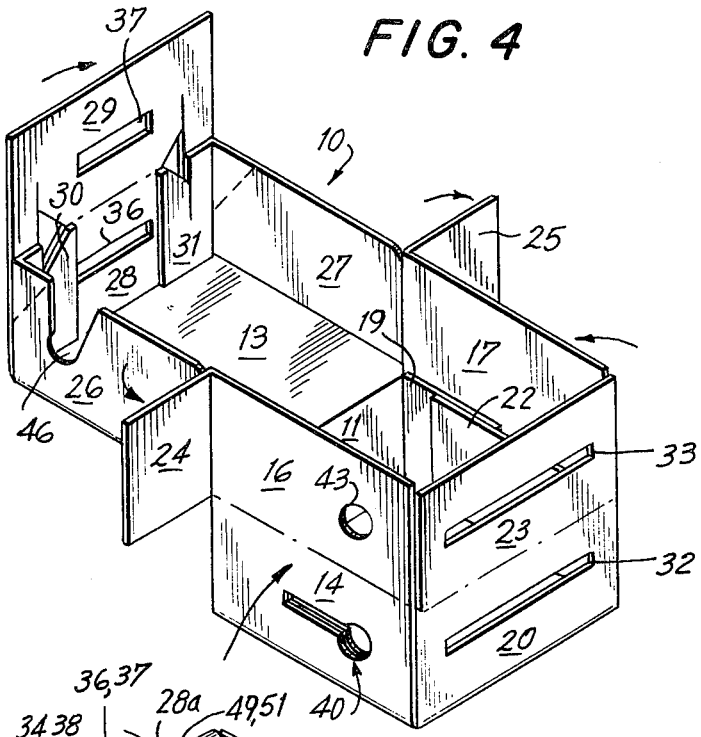
FIG. 4 is a perspective view of a partially assembled container, formed from the partially assembled container shown in FIG. 3.

Shown in FIG. 4 is the third step in folding the blank 10 to form the container 60. As seen in FIG. 4, the first end panel 14 and the second end panel 15 have been folded into an upstanding position relative to the first side panel 12. Also in FIG. 4, the second top panel reinforcing flap 28 has been folded into an upstanding position relative to the second side panel 13. As a result, the second, first end panel reinforcing flap 18 is located inwardly of and in face-to-face relationship with the bottom portion of the first end panel 14; the third, first end panel reinforcing flap 21 is located inwardly of and in face-to-face relationship with the top portion of the first end panel 14; the second, second end panel reinforcing flap 19 is located inwardly of and in face-to-face relationship with the bottom portion of the second end panel 15; and the third, second end panel reinforcing flap 22 is located inwardly of and in face-to-face relationship with the top portion of the second end panel 15. Also, as a result, the fourth and fifth top panel reinforcing flaps 30 and 31 are located inwardly of and in face-to-face relationship with the second top panel reinforcing flap 28.

Figure 5:
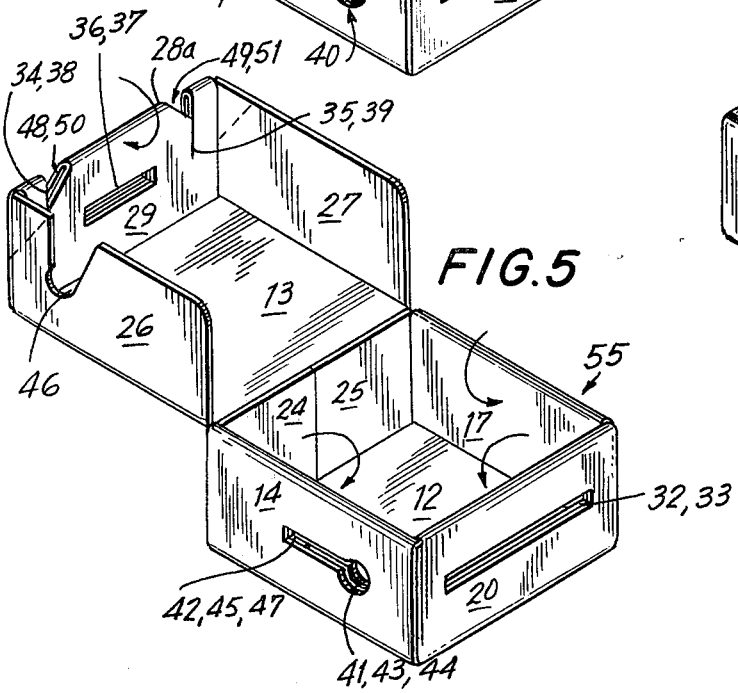
FIG. 5 is a perspective view of an open container, formed from the partially assembled container shown in FIG. 4.

Shown in FIG. 5 is the fourth step in folding the blank 10 to form the container 60. As seen in FIG. 5, the first, first end panel reinforcing flap 16 has been folded inwardly of the first end panel 14, and the first, second end panel reinforcing flap 17 has been folded inwardly of the second end panel 15. As also seen in FIG. 3, the first top panel reinforcing flap 23 has been folded inwardly of the top panel 20, and the third top panel reinforcing flap 29 has been folded inwardly of the second top panel reinforcing flap 28. As a result, the first, first end panel reinforcing flap 16 is located inwardly of and in face-to-face relationship with the second and third, first end panel reinforcing flaps 18 and 21, and the first, second end panel reinforcing flap 17 is located inwardly of and in face-to-face relationship with the second and third, second end panel reinforcing flaps 19 and 22. Also as a result, the first and second bottom panel reinforcing flaps 24 and 25 are located inwardly of and in face-to-face relationship with the bottom panel 11. Further as a result, the edges 24a and 25a of the bottom panel reinforcing flaps 24 and 25, remote from the first, first end panel reinforcing flap 16 and the first, second end panel reinforcing flap 17 respectively, overlap or, preferably, abut. Still further as a result, the third top panel reinforcing flap 29 is located inwardly of and in face-to-face relationship with the fourth and fifth top panel reinforcing flaps 30 and 31, and the first top panel reinforcing flap 23 is located inwardly of and in face-to-face relationship with the top panel 20.

As folded in FIG. 5, the flaps and panels 11–31 of blank 10 form an open container, generally 55. The flaps and panels in the open container 55 tend to stay in place after being folded. In FIG. 5, the first and second slots 32 and 33 are centered in the top panel 20 and the first top panel reinforcing flap 23 respectively and are substantially aligned and coextensive. Also in FIG. 5, the third and fourth slots 36 and 37, in the second and third top panel reinforcing flaps 28 and 29 respectively, are substantially aligned and coextensive. Further in FIG. 5, the first and third handle slits 34 and 38 are substantially aligned and coextensive, and the second and fourth handle slits 35 and 39 are substantially aligned and coextensive in the open container 55. Still further in FIG. 5, the first, second and third; substantially round, wire-dispensing holes 41, 43 and 44, in the first end panel 14, the first, first end panel reinforcing flap 16, and the third, first end panel reinforcing flap 21 respectively, are substantially aligned and coextensive, and the first and second wire-retaining slots 42 and 45 and the wire-retaining second notch 47, in the first end panel 14 and the third and second, first end panel reinforcing flaps 21 and 18 respectively, also are substantially aligned. Also in the open container shown in FIG. 5, the first handle notch 48 is substantially aligned and coextensive with the first handle cut-out 50, and the second handle notch 49 is substantially aligned and coextensive with the second handle cut-out 51.

The open container 55 can be filled with a spool or roll (not shown) of wire, twine, rope or the like. Preferably, a spool of a heavy duty, insulated electrical wire or the like, which can weigh from 20 to 50 pounds, is placed within the open container 55. The open container 55 then can be closed to store the wire until it is ready to be used by a consumer.

Figure 6:
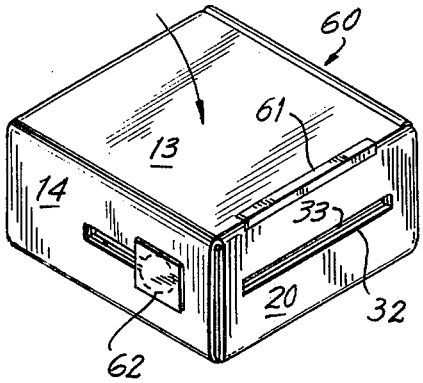
FIG. 6 is a perspective view of a closed container, in accordance with this invention, formed from the open container shown in FIG. 5.

In FIG. 6 is shown the last step in folding the blank 10 to form the closed container 60. In FIG. 6, the second side panel 13 has been folded about the bottom panel 11, towards the first side panel 12, to close the container. During this step, the lateral portions of the second top panel reinforcing flap 28 have been forcefully depressed, towards the bottom panel 11, so that the fourth, first and second end panel reinforcing flaps 26 and 27 are creased along crease lines 52 and 53. As a result, as folded, the fourth, first end panel reinforcing flap 26 is located inwardly of and in face-to-face relationship with the first, first end panel reinforcing flap 16, and the fourth, second end panel reinforcing flap 27 is located inwardly of and in face-to-face relationship with the first, second end panel reinforcing flap 17. Also as folded, the second top panel reinforcing flap 28 is located inwardly of and in face-to-face relationship with the first top panel reinforcing flap 23. Further as folded, the fourth, first and second end panel reinforcing flaps 26 and 27 are deformed about the crease lines 52 and 53 so that these flaps 26 and 27 fit snugly within container 60 and adjacent its end panels 14 and 15.

As shown in FIG. 6, a piece of adhesive tape 61 preferably is placed over the adjacent portions of the top panel 20 and the second side panel 13 after the container 60 has been filled with wire. Also, a second piece of adhesive tape 62 preferably is placed over the first key shaped hole 40 or the first wire-dispensing hole 41 in the first end panel 14. Thereby, a closed hexahedronal container 60 is provided for storing wire and the like.

Figure 7:
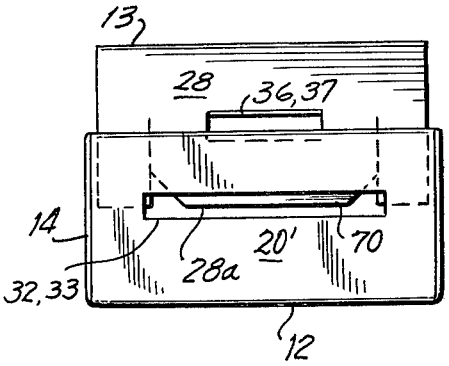
FIG. 7 is a top view of a partially opened container, in accordance with this invention, wherein the handle construction in the container is in position to be urged through a slot in the top wall of the container.

Shown in FIG. 7 is a first step in assembling a handle construction, generally 70, for use when carrying the container 60 and dispensing wire from it. As seen in FIG. 7, the pieces of adhesive tape 61 and 62 have been removed from the container 60. As also seen in FIG. 7, the second side panel 13 has been folded somewhat about bottom panel 11, away from the first side panel 12, to partially open the container 60. In this step, the container 60 need not be opened all the way, as in FIG. 5. Rather, the second side panel 13 need only be foled a sufficient distance away from the first side panel 12 so that the side **28*a* of the second top panel reinforcing flap 28, connected to the third top panel reinforcing flap 29, has moved either: past the first and second slots 32 and 33, in the top panel 20 and the first top panel reinforcing flap 23 respectively; or so that it can be seen through the first and second slots 32 and 33, as in FIG. 7. By this step, the handle construction 70 in partially opened container 60 is in position to be pushed through the first and second slots 32 and 33**.

The handle 70, formed by the portions of the second and third top panel reinforcing flaps 28 and 29 between the first and second handle slits 34 and 35, then is urged through the first and second slots 32 and 33, as a second step. The handle 70 can be urged through the slots 32 and 33 merely by: forcefully pressing downwardly on the portion 20' of the top panel 20 adjacent slot 32 and closest to the first side panel 12; and at the same time, forcefully reclosing the container 60 by folding the second side panel 13 about bottom panel 11 towards the first side panel 12. To assist in forcing the handle 70 through the slots 32 and 33, one can grasp and pull the second and third top panel reinforcing flaps 28 and 29 through the slots 32 and 33 while reclosing the container 60.

Figure 8:
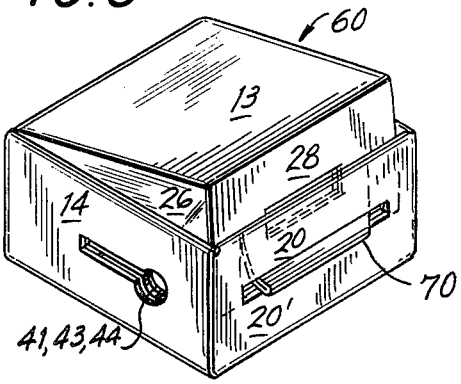
FIG. 8 is a perspective view of a partially opened container, showing the handle construction after a portion thereof has been urged through the slot in the top wall of the container.

Shown in FIG. 8 is the second step in setting-up the handle 70. In FIG. 8, portions of the second and third top panel reinforcing flaps 28 and 29 have been pushed outwardly of the container 60 through the first and second slots 32 and 33. Also in FIG. 8, the container 60 has been partially reclosed, after having been partially opened in FIG. 7, the first and second side panels 12 and 13 having been folded towards each other about bottom panel 11.

Figure 9:
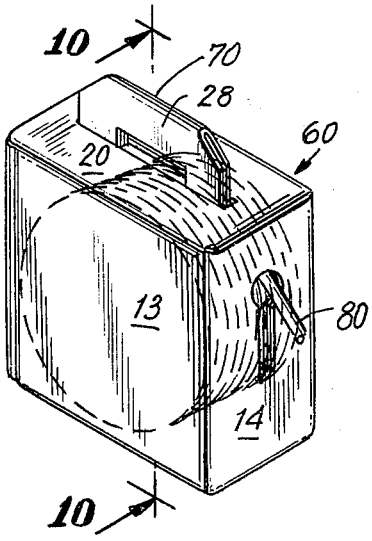
FIG. 9 is a perspective view of the container, in accordance with this invention, adapted to carry and dispense wire. The handle construction of the container has been urged completely through the slot in the top wall of the container and is in an upstanding position, extending outwardly of the container. Wire from within the container extends through a key shaped hole in an end wall of the container.

In FIG. 9 is shown the reclosed container 60, ready to dispense wire. As seen in FIG. 9, a piece of wire 80 extends outwardly of the container 60 through the substantially round wire-dispensing holes 41, 43 and 44. Also as seen in FIG. 9, the handle construction 70 extends all the way out of the container 60, through the first slot 32 in the top panel 20. The handle 70 has been folded into an upstanding position relative to the top panel 20. To facilitate the folding of the handle 70 into an upstanding position, the third and fourth slots 36 and 37 are preferably provided adjacent to the lines connecting the ends of the first and second handle slits 34 and 35 in the second and third top panel reinforcing flaps 28 and 29 respectively.

The handle construction 70, in accordance with this invention, comprises the portions of the second and third top panel reinforcing flaps 28 and 29, between the first and second handle slits 34 and 35, that extend outwardly of the first slot 32 in the top panel 20 and that are in an upstanding position in relation to the top panel 20. The central portions of the handle 70, adjacent the top panel 20, include the aligned third and fourth slots 36 and 37. The lateral portions of the handle 70, adjacent the first and second handle slits 34 and 35, are reinforced by the portions 30' and 31' of the fourth and fifth top panel reinforcing flaps 30 and 31 which lie between and in face-to-face relationship with the portions of the second and the third top panel reinforcing flaps 28 and 29 between the first and second handle slits 34 and 35.

The container 60 in FIG. 9 is adapted to be carried by its handle 70. The container 60 will not tear when held by its handle, even when filled with 20 to 50 pounds of metal wire or the like. Also, if dropped, container 60 will not break or fall apart or come open. Furthermore, the wire in the container can be easily dispensed by pulling it out through the wire-dispensing holes 41, 43 and 44, in the first end panel 14 and its first and third reinforcing flaps 16 and 21 respectively.

In accordance with this invention, the hexahedronal, wire dispenser container 60 has bottom, top and end walls reinforced by at least one additional layer of paperboard material. The strength of container 60, its impact resistance, and its ability to maintain its integrity and to remain closed when carried by its handle or when dropped from a height of up to 20 feet are achieved by utilizing the closely interfolded panels and reinforcing flaps 11 and 14–31 in the bottom, top and end walls of the container 60. Surprisingly, the beneficial results provided by container 60 are obtained without the need for adhesives, tapes or the like for bonding or reinforcing the panels and flaps of container 60.

Figure 10:
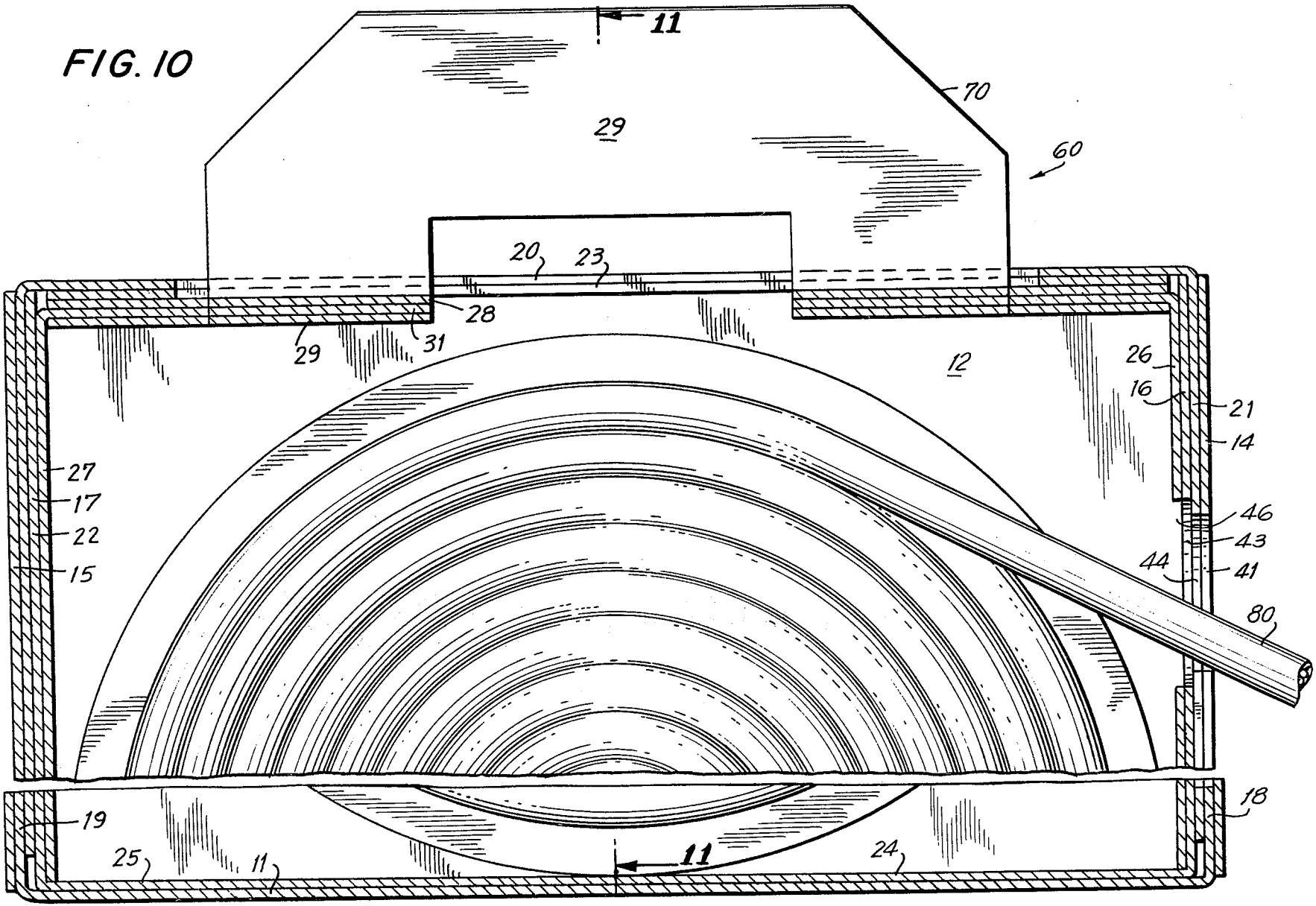
FIG. 10 is a fragmentary sectional view taken along line 10—10 in FIG. 9, at the center of the container and its handle.

Shown in FIG. 10 is the closely interfolded relationship of the flaps and panels which form the reinforced bottom and end walls of the container 60. As seen in FIG. 10, one end wall is formed from the first end panel 14 and the four inner adjacent end panel reinforcing flaps 16, 18, 21 and 26, wherein the third, first end panel reinforcing flap 21 is outwardly of the first, first end panel reinforcing flap 16 and inwardly of the second, first end panel reinforcing flap 18 and wherein the fourth, first end panel reinforcing flap 26 is located inwardly of the first, first end panel reinforcing flap 16. Likewise, the other end wall of the container 60 is formed from the second end panel 15 and its adjacent, inwardly located, four reinforcing flaps 17, 19, 22 and 27, wherein the third, second end panel reinforcing flap 22 is located inwardly of the second, second and panel reinforcing flap 19 and outwardly of the first, second end panel reinforcing flap 17 and wherein the fourth, second end panel reinforcing flap 27 is located inwardly of the first, second end panel reinforcing flap 17. As also, seen in FIG. 10, the bottom wall of the container 60 is formed by the bottom panel 11 and the overlying, adjacent, first and second, bottom panel reinforcing flaps 24 and 25.

Figure 11:
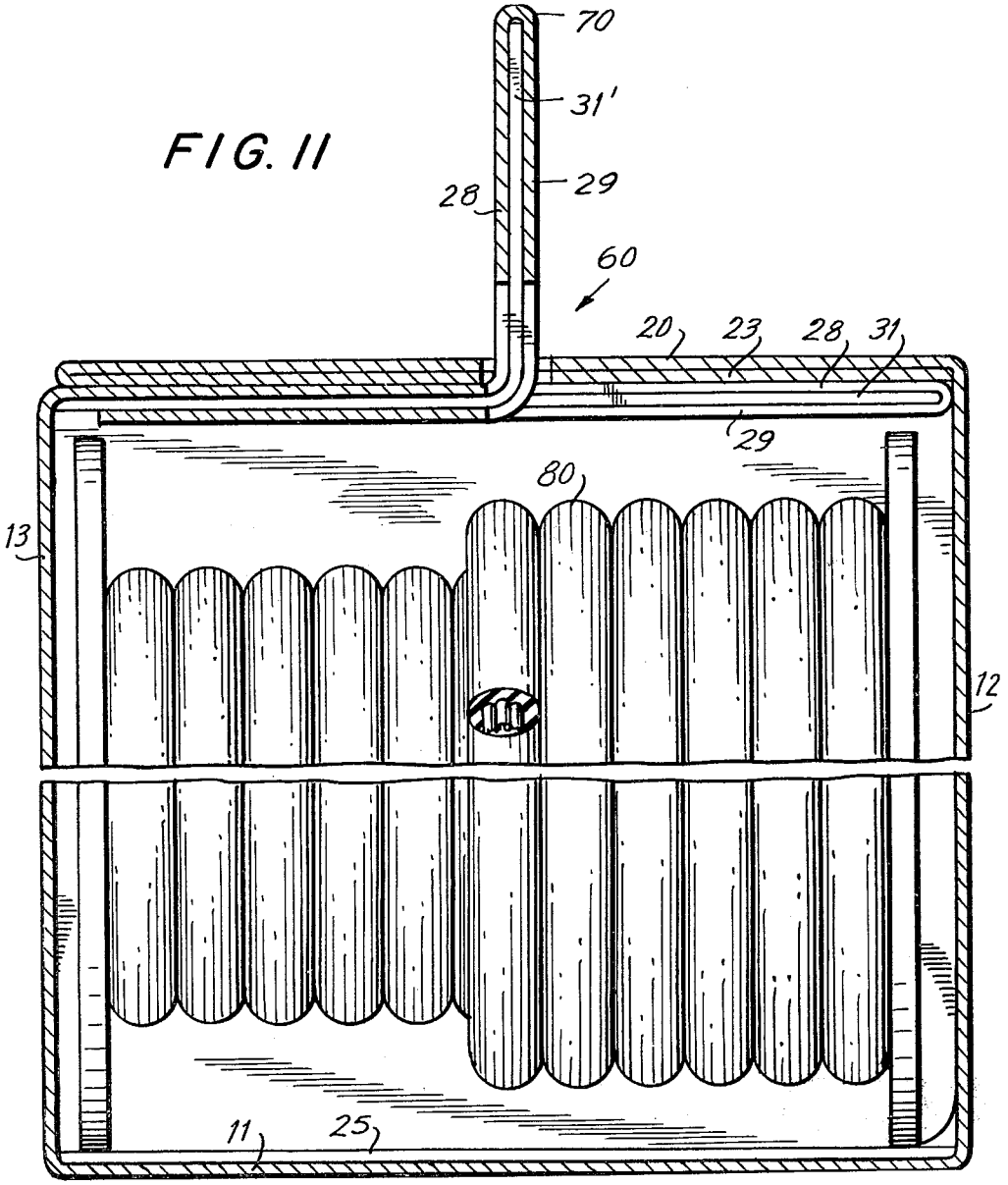
FIG. 11 is a fragmentary sectional view taken along line 11—11 in FIG. 10.

Shown in FIG. 11 is the closely interfolded relationship of the flaps and panels which form the reinforced top wall of the container 60. From FIG. 11, the top wall is seen to include the top panel 20 and five adjacent underlying reinforcing flaps 23, 28, 29, 30 (not shown) and 31. In the top wall of the container 60, the second to panel reinforcing flap 28 lies between an upper first top panel reinforcing flap 23 and a lower fourth top panel reinforcing flap 30 (not shown) and fifth top panel 31. Also in the top wall of the container 60, the third top panel reinforcing flap 29 underlies the fourth and fifth top panel reinforcing flaps 30 and 31. Further in the top wall, the fourth and fifth top panel reinforcing flaps 30 and 31 strengthen substantially the entire lateral portions of the top wall, located between the first and second handle slits 34 and 35 and the end walls of the container 60.

Figure 12:
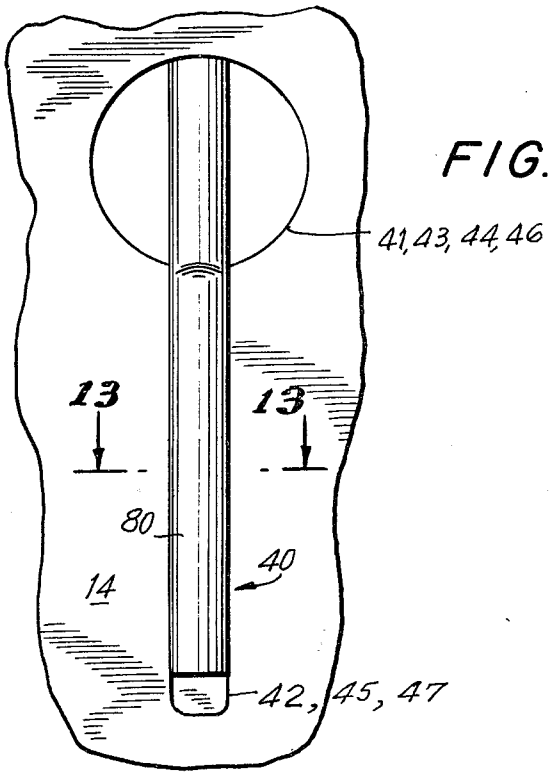
FIG. 12 is a fragmentary detailed plan view of the round wire-dispensing hole and the wire-retaining slot of the key shaped hole in the end wall of the container. Wire extends through the wire-dispensing hole, and the end portions of the wire are embedded between the widthwise edges of the wire-retaining slot.

Shown in FIG. 12 is the end of wire 80, extending outwardly of container 60. Wire 80 exits from container 60 through the first wire-dispensing hole 41 in the first key shaped hole 40 as well as through the other wire-dispensing holes 43 and 44 and the wire-dispensing first notch 46, in the first, third and fourth, first end panel reinforcing flaps 16, 21 and 26 respectively. The end of the wire 80 lies within the first wire-retaining slot 42 in the first key shaped hole 40 in the first end panel 14, as well as in the second wire-retaining slot 45 and the wire-retaining second notch 47, in the third and second, first end panel reinforcing flaps 21 and 18 respectively. That the end of the wire 80 is embedded in the wire-retaining slots and notch 42, 45 and 47 allows it to be held outwardly of the container 60 in a position where it can be easily grasped for dispensing the wire. This feature prevents the end of the wire from falling through the wire-dispensing holes and back into the container. As indicated above, the dimensions and configurations of the wire-dispensing holes and wire-retaining slots in the end panel and end panel reinforcing flaps of container 60 are not critical. Preferably, however, the wire-dispensing holes and notch 41, 43, 44 and 46 are substantially larger than the diameter of the wire 80, while the wire-retaining slots and notch 42, 45 and 47 preferably have a width equal to or slightly less than the width of the wire 80. It is especially preferred that the width of the first wire-retaining slot 42 be somewhat less than the diameters of the wire 80. This allows the end of the wire 80 to be snugly held outside of the container 60 merely by urging the end of the wire 80 into the first wire-retaining slot 42.

Figure 13:
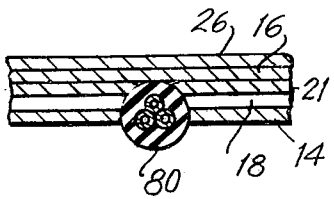
FIG. 13. is a fragmentary schematic sectional view taken along line 13—13 in FIG. 12.

Shown in FIG. 13 is an insulated electrical wire 80 which is tightly held outwardly of container 60 by the wire-retaining slots and notch 42, 45 and 47, in the first end panel 14 and the third and second, first end panel reinforcing flaps 21 and 18 respectively. As seen from FIG. 13, the wire 80 is held almost flush with the outer surface of end panel 14 by the wire-retaining slots and notch 42, 45 and 47 of container 60.

It is thought that the use of all the interfolded panels and flaps 11–31 of this invention is necessary in order to provide the strength and impact resistance qualities found in the hexahedronal, wire dispenser container 60. It is also believed that the use of the integral handle construction 70 and the one or more key shaped holes 40 and 40' in combination with all the flaps and panels 11–31 is preferred in order to provide a wire dispenser container 60 having all the improved properties set forth above. However, the usefulness of the handle construction 70 and the key shaped holes 40 and 40' of this invention is not considered dependent upon the use of these features in combination with each and every panel and flap 11–31 of the cut and scored, paperboard blank 10 for container 60.

Rather, the integral handle construction 70 of this invention can be formed in any suitable container: having side panels 12 and 13 which are foldably connected to opposite sides of a bottom panel 11; having a top panel 20, provided on one side panel 12, and a top panel reinforcing flap 28, provided on the second side panel 13; and having an elongated slot 32 in the top panel 20 and a pair of handle slits 34 and 35 in the top panel reinforcing flap 28; wherein the slits 34 and 35 extend from the side 28*a* of the flap 28 remote from the second side panel 13 and are located between the opposite lengthwise ends 32a of the slot 32. The handle slits 34 and 35 of the handle 70 can be parallel or non-parallel, but, if parallel, the slits 34 and 35 are preferably substantially transverse to the slot 32, i.e., its lengthwise center line. In a container, this handle construction can be expeditiously assembled, so that the handle extends outwardly of the container, by the two steps of: partially opening the container by folding its side panels 12 and 13 apart; and the, closing the container by folding its side panels 12 and 13 together while urging the portions of the top panel reinforcing flap 28 between the handle slits 34 and 35 through the slot 32 in the top panel 20.

Also in any appropriate container, the preferred integral handle construction of this invention can include: an additional top panel reinforcing flap 29, connected to the side 28*a* of the top panel reinforcing flap 28 remote from the second side panel 13; wherein the additional flap 29 contains a pair of handle slits, each of which intersects one or both, preferably one, of the slits in the top panel reinforcing flap 28 along its side 28*a*. The handle slits in the additional top panel reinforcing flap 29, as in the top panel reinforcing flap 28, can be parallel or non-parallel. However, each handle slit in the additional flap 29 must be a substantial mirror image, along the side 28a of the top panel reinforcing flap 28, of a handle slit in the top panel reinforcing flap 28 which it intersects along side 28a. Where the pair of handle slits in the top panel reinforcing flap 28 are parallel and transverse to side 28*a*, the pair of handle slits in the additional flap 29 also must be substantially parallel and transverse to side 28*a*, thus forming the pair of parallel handle slits 34 and 35 in flaps 28 and 29 of the preferred embodiment of container 60 of this invention. In a container, this preferred handle construction can be suitably assembled so that each of the pair of handle slits in the top panel reinforcing flap 28 is substantially aligned and coextensive with one of the pair of handle slits in the underlying additional top panel reinforcing flap 29.

Further in any suitable container, the especially preferred handle of this invention can be reinforced by providing, between the top panel reinforcing flaps 28 and 29, portions 30' and 31' of further additional top panel reinforcing flaps 30 and 31, that are connected to the opposite sides of the second side panel 13 and that contain additional handle slits 38 and 39. The additional handle slits 38 and 39 extend from the sides 30*a* and 31*a* of the further additional flaps 30 and 31 remote from the second side panel 13 and respectively define the boundaries of the reinforcing flap portion 30' and 31' remote from the top panel reinforcing flap 28. One additional handle slit 38 must be a substantial mirror image along the side 30a of its closer handle slit 34, in the top panel reinforcing flap 28, along the side 28*a* of the top panel reinforcing flap 28. The other additional handle slit 39 must be a substantial mirror image along the side 31a of its closer handle slit 35, in the top panel reinforcing flap 28, along the side 28*a*. Where the pairs of handle slits 34 and 35 in the top panel reinforcing flap 28 and in the additional top panel reinforcing flap 29 are substantially parallel and transverse to side 28*a*, the additional handle slits 38 and 39 must be substantially transverse to the handle slits in the top panel reinforcing flaps 28 and 29, thus forming the third and fourth handle slits 38 and 39 of the preferred container 60 of this invention. In a container, this especially preferred handle construction can be suitably assembled so that each additional handle slit 38 and 39 lies between and is substantially aligned and coextensive with one of the pair of slits in the overlying top panel reinforcing flap 28 and with one of the pair of slits in the underlying additional top panel reinforcing flap 29. Also in a container, the reinforcing flap portions 30' and 31', as positioned between the top panel reinforcing flaps 28 and 29, lie between the pairs of handle slits in the flaps 28 and 29 and are not connected to their respective further additional top panel reinforcing flaps 30 and 31 across the handle slits in the flaps 28 and 29.

Also in accordance with this invention, the first key shaped hole 40 can be provided in the end panel 14 of any suitable container wherein the end of a length of wire or the like, to be dispensed from the container, is to be held in a readily accessible position outwardly of an end panel 14. Preferably, the key shaped hole 40 is utilized in combination with an end panel 14 which is reinforced with one or more reinforcing flaps 16, 18, 21 and 26, particularly where one or more of the adjacent reinforcing flaps 18 and 21, in face-to-face relationship with the end panel 14, also include a key shaped hole 40' or the equivalent thereof. It is especially preferred that not all of the end panel reinforcing flaps 16, 18, 21 and 26 be provided with key shaped holes. Rather, at least one of the end wall reinforcing flaps 16 and 26 should be provided with no wire-retaining slot but only with a substantially round, wire-dispensing hole 43, or the equivalent thereof, through which wire can be pulled from the container 60.

It is thought that the invention and many of its attendant advantages will be understood from the foregoing description, and it will be apparent that various changes may be made in the form, construction and arrangement of the parts without departing from the spirit and scope of the invention or sacrificing all of its material advantages, the form hereinbefore described being a perferred embodiment thereof.

We claim:

1. A cut and scored, paperboard blank (10) for a hexahedronal container, having bottom, top and end walls reinforced by at least one additional layer of paperboard material, which comprises:

a bottom panel (11);

a first side pane (12) and a second side panel (13) connected to opposite sides of the bottom panel (11);

a first end panel (14) and a second end panel (15) connected to opposite sides of the first side panel (12);

a first, first end panel reinforcing flap (16) connected to a side of the first end panel (14) remote from the first side panel (12);

a first, second end panel reinforcing flap (17) connected to a side of the second end panel (15) remote from the first side panel (12);

a second, first end panel reinforcing flap (18) and a second, second end panel reinforcing flap (19) connected to the other opposite sides of the bottom panel (11);

a top panel (20) connected to a side of the first side panel (12) remote from the bottom panel (11);

a third, first end panel reinforcing flap (21) and a third, second end panel reinforcing flap (22) connected to opposite sides of the top panel (20);

a first top panel reinforcing flap (23) connected to a side of the top panel (20) remote from the the first side panel (12);

a first bottom panel reinforcing flap (24) connected to a side of the first, first end panel reinforcing flap (16) remote from the third, first end panel reinforcing flap (21);

a second bottom panel reinforcing flap (25) connected to a side of the first, second end panel reinforcing flap (17) remote from the third, second end panel reinforcing flap (22);

a fourth, first end panel reinforcing flap (26) and a fourth, second end panel reinforcing flap (27) connected to opposite sides of the second side panel (13);

a second top panel reinforcing flap (28) connected to a side of the second side panel (13) remote from the bottom panel (11);

a third top panel reinforcing flap (29) connected to a side of the second top panel reinforcing flap (28) remoted from the second side panel (13);

a fourth top panel reinforcing flap (30) connected to a side of the fourth, first end panel reinforcing flap (26) remote from the first end panel (14); and a fifth top panel reinforcing flap (31) connected to a side of the fourth, second end panel reinforcing flap (27) remote from the second end panel (15);

the first end panel (14), the first end panel reinforcing flaps (16, 18, 21, and 26) and the fourth top panel reinforcing flap (30) being adjacent to one another; and the second end panel (15), the second end panel reinforcing flaps (17, 19, 22 and 27) and the fifth top panel reinforcing flap (31) being adjacent to one another.

2. The blank of claim 1 wherein the top panel (20) includes a first elongated slot (32) and the first top panel reinforcing flap (23) includes a second elongated slot (33), the slots (32 and 33) being parallel to and equidistant from the connected sides of the top panel (20) and the first top panel reinforcing flap (23); and wherein the second and third, top panel reinforcing flaps (28 and 29) each include a pair of handle slits that intersect along their connected sides, are substantial mirror images along their connected sides and are located between the lengthwise ends of the first and second slots (32 and 33).

3. The blank of claim 2 wherein the fourth and fifth, top panel reinforcing flaps (30 and 31) each include an additional handle slit (38 and 39), each of which is a substantial mirror image, along a side (30a and 31a) of the fourth or fifth, top panel reinforcing flap (30 and 31) remote from the second top panel reinforcing flap (28), of the respectively closer handle slit in the second top panel reinforcing flap (28), along the connected sides of the second and third, top panel reinforcing flaps (28 and 29).

4. The blank of claim 2 wherein the pairs of handle slits in the second and third, top panel reinforcing flaps (28 and 29) comprises a first handle slit (34) and a second handle slit (35) that are: substantially parallel; substantially transverse to the connected sides of the second and third, top panel reinforcing flaps (28 and 29); substantially transverse to the slots (32 and 33); and respectively closer to the fourth top panel reinforcing flap (30) and the fifth top panel reinforcing flap (31).

5. The blank of claim 4 wherein the fourth top panel reinforcing flap (30) includes a third handle slit (38), parallel to the side of the fourth, first end panel reinforcing flap (26) connected to the fourth top panel reinforcing flap (30) and spaced from the parallel side of the fourth, first end panel reinforcing flap (26) by a distance equal to the distance between the first handle slit (34) and the adjacent side of the second top panel reinforcing flap (28) between the second and fourth top panel reinforcing flaps (28 and 30); and wherein the fifth top panel reinforcing flap (31) includes a fourth handle slit (39), parallel to the side of the fourth, second end panel reinforcing flap (27) connected to the fifth top panel reinforcing flap (31) and spaced from the parallel side of the fourth, second end panel reinforcing flap (27) by a distance equal to the distance between the second handle slit (35) and the adjacent side of the second top panel reinforcing flap (28) between the second and fifth top panel reinforcing flaps (28 and 31).

6. The blank of claim 5 wherein the third and fourth, handle slits (38 and 39) each have about one-half the length of the first or second, handle slit (34 or 35).

7. The blank of claim 2 wherein the second and third, top panel reinforcing flaps (28 and 29) each include an additional elongated slot (36 and 37) parallel to and equidistant from the connected sides of the second and third, top panel reinforcing flaps (28 and 29) and located between the handle slits (34 and 35).

8. The blank of claim 7 wherein the side of each additional slot (36 and 37) remote from the connected sides of the second and third, top panel reinforcing flaps (28 and 29) lies along the line connecting the ends of the handle slits (34 and 35) in the second or third, top panel reinforcing flap (28 and 29).

9. The blank of claim 1 wherein the first end panel (14) includes a key shaped hole.

10. The blank of claim 9 wherein the third, first end panel reinforcing flap (21) includes a key shaped hole.

11. The blank of claim 10 wherein the first, first end panel reinforcing flap (16) includes a substantially-round, wire-dispensing hole.

12. The blank of claim 10 wherein the second, first end panel reinforcing flap (18) includes an elongated wire-retaining notch extending from the side thereof remote from the bottom panel (11).

13. A paperboard hexahedronal container (60), having bottom, top and end walls reinforced by at least one additional layer of paperboard material, which comprises:

a bottom panel (11);

a first side panel (12) and a second side panel (13) connected to opposite sides of the bottom panel (11);

a first end panel (14) and a second end panel (15) connected to opposite sides of the first side panel (12);

a first, first end panel reinforcing flap (16) connected to a side of the first end panel (14) remote from the first side panel (12);

a first, second end panel reinforcing flap (17) connected to a side of the second end panel (15) remote from the first side panel (12);

a second, first end panel reinforcing flap (18) and a second, second end panel reinforcing flap (19) connected to the other opposite sides of the bottom panel (11);

a top panel (20) connected to a side of the first side panel (12) remote from the bottom panel (11);

a third, first end panel reinforcing flap (21) and a third, second end panel reinforcing flap (22) connected to opposite sides of the top panel (20);

a first top panel reinforcing flap (23) connected to a side of the top panel (20) remote from the first side panel (12);

a first bottom panel reinforcing flap (24) connected to a side of the first, first end panel reinforcing flap (16) remote from the third, first end panel reinforcing flap (21);

a second bottom panel reinforcing flap (25) connected to a side of the first, second end panel reinforcing flap (17) remote from the third, second end panel reinforcing flap (22);

a fourth, first end panel reinforcing flap (26) and a fourth, second end panel reinforcing flap (27) connected to opposite sides of the second side panel (13);

a second top panel reinforcing flap (28) connected to a side of the second side panel (13) remote from the bottom panel (11);

a third top panel reinforcing flap (29) connected to a side of the second top panel reinforcing flap (28) remote from the second side panel (13);

a fourth top panel reinforcing flap (30) connected to a side of the fourth, first end panel reinforcing flap (26) remote from the first end panel (14); and a fifth top panel reinforcing flap (31) connected to a side of the fourth, second end panel reinforcing flap (27) remote from the second end panel (15);

the bottom panel reinforcing flaps (24 and 25) being adjacent to and overlying the bottom panel (11);

the first and second side panels (12 and 13) being upstanding relative to the bottom panel (11);

the upstanding first end panel (14) and upstanding, first, second and fourth, end panel reinforcing flaps (16, 18 and 26), relative to the bottom panel (11), and the downwardly extending third, first end panel reinforcing flap (21), relative to the bottom panel (11), being adjacent to one another;

the upstanding second end panel (15) and upstanding, first, second and fourth, second end panel reinforcing flaps (17, 19 and 27), relative to the bottom panel (11), and the downwardly extending third, second end panel reinforcing flap (22), relative to the bottom panel (11), being adjacent to one another; and the first, second, third, fourth and fifth, top panel reinforcing flaps (23, 28, 29, 30 and 31) being adjacent to and underlying the top panel (20);

each second and third, end panel reinforcing flap (18, 19, 21 and 22) being located inwardly of the adjacent end panel (14 and 15), and each first end panel reinforcing flap (16 and 17) being located inwardly of the adjacent third end panel reinforcing flap (21 and 22) and outwardly of the adjacent fourth end panel reinforcing flap (26 and 27); and the fourth and fifth, top panel reinforcing flaps (30 and 31) underlying the second top panel reinforcing flap (28) and overlying the third top panel reinforcing flap (29), and the first top panel reinforcing flap (23) underlying the top panel (20) and overlying the second top panel reinforcing flap (28).

14. The container of claim 13 wherein each second end panel reinforcing flap (18 and 19) is located outwardly of the adjacent third end panel reinforcing flap (21 and 22).

15. The container of claim 13 wherein the top panel (20) and the first top panel reinforcing flap (23) each include an elongated slot (32 and 33) extending parallel to and being equidistant from the connected sides of the top panel (20) and the first top panel reinforcing flap (23); and wherein the second and third, top panel reinforcing flaps (28 and 29) each include a pair of handle slits that intersect along their connected sides, are substantially aligned and coextensive, and are located between the lengthwise ends of the slots (32 and 33).

16. The container of claim 15 wherein the fourth and fifth, top panel reinforcing flaps (30 and 31) each include an additional handle slit (38 and 39), each of which lies between and is substantially aligned and coextensive with one of the handle slits in the overlying second and underlying third, top panel reinforcing flaps (28 and 29).

17. The container of claim 15 wherein the pairs of handles slits in the second and third, top panel reinforcing flaps (28 and 29) comprise a first handle slit (34) and a second handle slit (35) that are: substantially parallel; substantially transverse to the connected sides of the second and third, top panel reinforcing flaps (28 and 29); substantially transverse to the slots (32 and 33); and respectively closer to the first end panel (14) and the second end panel (15).

18. The container of claim 17 the fourth top panel reinforcing flap (30) includes a third handle slit (38), parallel to the side of the fourth, first end panel reinforcing flap (26) connected to the fourth top panel reinforcing flap (30) and spaced from the parallel side of the fourth, first end panel reinforcing flap (26) by a distance equal to the distance between the first handle slit (34) and the side of the second top panel reinforcing flap (28) adjacent to the first end panel (14); and wherein the fifth top panel reinforcing flap (31) includes a fourth handle slit (39), parallel to the side of the fourth, second end panel reinforcing flap (27) connected to the fifth top panel reinforcing flap (31) and spaced from the parallel side of the fourth, second end panel reinforcing flap (27) by a distance equal to the distance between the second handle slit (35) and the side of the second top panel reinforcing flap (28) adjacent to the second end panel (15).

19. The container of claim 18 wherein the third and fourth handle slits (38 and 39) each havve one-half the length of the first or second, handle slit (34 or 35).

20. The container of claim 15 wherein the second and third, top panel reinforcing flaps (28 and 29) each include an additional elongated slot (36 and 37) parallel to and equidistant from the connected sides of the second and third, top panel reinforcing flaps (28 and 29) and located between the handle slits (34 and 35).

21. The container of claim 20 wherein one side of each additional slot (36 and 37) remote from the connected sides of the second and third, top panel reinforcing flaps (28 and 29) lies along the line connecting the ends of the handle slits (34 and 35) in the second or third, top panel reinforcing flap (28 or 29).

22. The container of claim 13 wherein the portions of the second and third top panel reinforcing flaps (28 and 29) between the handle slits (34 and 35) extend through the slots (32 and 33).

23. The container of claim 13 wherein the first end panel (14) includes a key shaped hole (40), comprising a substantially round, wire-dispensing hole (41) and an elongated wire-retaining slot (42) having a width substantially less than the diameter of the round hole (41).

24. The container of claim 23 wherein the third, first end panel reinforcing flap (21) also includes a key shaped hole, which comprises a substantially round, wire-dispensing hole and an elongated wire-retaining slot; the key shaped holes in the first end panel (14) and in the third, first end panel reinforcing flap (21) being substantially aligned.

25. The container of claim 24 wherein the first, first end panel reinforcing flap (16) includes a substantially round, wire-dispensing hole, that is substantially aligned with the wire-dispensing holes in the first end panel (14) and in the third, first end panel reinforcing flap (21).

26. A cut and scored, paperboard blank for a container with an integral handle, which comprises:

a bottom panel (11);

a first side panel (12) and a second side panel (13) connected to opposite sides of the bottom panel (11);

a top panel (20) connected to a side of the first side panel (12) remote from the bottom panel (11); and a top panel reinforcing flap (28) connected to a side of the second side panel (13) remote from the bottom panel (11);

an elongated slot (32) being provided in the top panel (20); and a pair of handle slits (34 and 35) being provided in the top panel reinforcing flap (28) that extend from a side (28a) of the top panel reinforcing flap (28) remote from the second side panel (13) and that are located between the lengthwise ends of the slot (32).

27. The blank of claim 26 wherein the handle slits (34 and 35) are parallel and substantially transverse to the side (28a) of the top panel reinforcing flap (28).

28. The blank of claim 26 wherein an additional top panel reinforcing flap (29) is provided, connected to the side (28a) of the top panel reinforcing flap (28), the additional flap (29) containing a pair of handle slits (34 and 35) that are a substantial mirror image of the pair of handle slits in the top panel reinforcing flap (28), along the side (28a) of the top panel reinforcing flap (28), and that intersect the pair of slits in the top panel reinforcing flap (28) along the (28a) thereof.

29. The blank of claim 28 wherein, in each pair of handle slits in the top panel reinforcing flap (28) and in the additional top panel reinforcing flap (29), the handle slits are parallel and transverse to the side (28a) of the top panel reinforcing flap.

30. A paperboard container with an integral handle, which comprises:

a bottom panel (11);

an upstanding first side panel (12) and an upstanding second side panel (13) connected to opposite sides of the bottom panel (11);

a top panel (20) connected to a side of the first side panel (12) remote from the bottom panel (11); and a top panel reinforcing flap (28) connected to a side of the second side panel (13) remote from the bottom panel (11) and being adjacent to and underlying the top panel (20);

an elongated slot (32) being provided in the top panel (20); and a pair of handle slits (34 and 35) being provided in the top panel reinforcing flap (28) that extend from a side (28a) of the top panel reinforcing flap (28) remote from the second side panel (13) and that are located between the lengthwise ends of the slot (32).

31. The container of claim 30 wherein the portions of the top panel reinforcing flap (28) between the handle slits (34 and 35) extend through the slot (32).

32. The container of claim 30 wherein the handle slits (34 and 35) are parallel and substantially transverse to the side (28a) of the top panel reinforcing flap (28).

33. The container of claim 30 wherein an additional top panel reinforcing flap (29) is provided, connected to the side (28a) of the top panel reinforcing flap (28) and underlying the top panel reinforcing flap (28); the additional flap (29) containing a pair of handle slits (34 and 35) that are substantially aligned and coextensive with the handle slits in the overlying top panel reinforcing flap (28) and intersect the pair of slits in the top panel reinforcing flap (28) along the side (28a) thereof.

34. The container of claim 33 wherein, in each pair of handle slits in the top panel reinforcing flap (28) and in the additional top panel reinforcing flap (29), the handle slits (34 and 35) are parallel and substantially transverse to the side (28a) of the top panel reinforcing flap (28).

35. The container of claim 32 wherein a pair of further additional top panel reinforcing flaps (30 and 31), connected to opposite sides of the second side panel (13), are provided; the further additional top panel reinforcing flaps (30 and 31) underlying the top panel reinforcing flap (28) and overlying the additional top panel reinforcing flap (29); and the further additional top panel reinforcing flaps (30 and 31) each including an additional handle slit (38 and 39) that is substantially alinged and coextensive with and lies between one of the handle slits in each pair of handle slits in the top panel reinforcing flap (28) and the additional top panel reinforcing flap (29).

36. In a cut and scored, paperbord blank for a container for dispensing wire or the like, having a reinforced wall which includes an outer panel (14) and an adjacent inner reinforcing flap (16), the improvement which comprises:

a key shaped hole in the outer panel (14), comprising a substantially round, wire-dispensing hole connected to an elongated wire-retaining slot having a width substantially less than the diameter of the round wire-dispensing hole; and a substantially round, wire-dispensing hole in the reinforcing flap (16).

37. In a container for dispensing wire or the like, having a reinforced wall which includes an outer panel (14) and an adjacent inner reinforcing flap (16), the improvement which comprises:

a key shaped hole in the outer panel (14), comprising a substantially round, wire-dispensing hole connected to an elongated wire-retaining slot having a width substantially less than the diameter of the round wire-dispensing hole; and a substantially round, wire-dispensing hole in the reinforcing flap (16), aligned with the wire-dispensing hole in the outer panel (14).

38. The container of claim 37 wherein the reinforced wall includes an additional reinforcing flap (21) having a key shaped hole aligned with the key shaped hole in the outer panel (14).

39. The container of claim 37 wherein the reinforced wall includes an additional reinforcing flap (18) having a wire-retaining notch aligned with the wire-retaining slot in the outer panel (14).

* * * * *

UNITED STATES PATENT AND TRADEMARK OFFICE

CERTIFICATE OF CORRECTION

PATENT NO. 4,006,854

DATED February 8, 1977

INVENTOR(S) : Gibson et al.

It is certified that error appears in the above-identified patent and that said Letters Patent are hereby corrected as shown below:

at column 1, line 48, "the", second occurrence, should be -- to -- ;

at column 1, line 62, "aa" should be -- a -- ;

at column 6, line 23, after "are", should be inserted -- not -- ;

at column 6, line 44, "29" should be -- 39 -- ;

at column 8, line 4, "holee" should be -- hole -- ;

at column 9, line 61, before "31", should be inserted -- flap -- ;

at column 11, line 21, ";" should be -- , -- ;

at column 12, line 13, "foled" should be -- folded -- ;

at column 13, line 52, after "also", should be deleted -- , -- ;

at column 13, line 62, "to" should be -- top -- ;

at column 20, line 49, "havve" should be -- have -- ; and at column 20, line 49, before "one", should be inserted -- about -- .

Signed and Sealed this

Third Day of May 1977

[SEAL]

*Attest:*

RUTH C. MASON
*Attesting Officer*

C. MARSHALL DANN
*Commissioner of Patents and Trademarks*